US007448610B2

(12) United States Patent
Ito et al.

(10) Patent No.: US 7,448,610 B2
(45) Date of Patent: Nov. 11, 2008

(54) PAPER-FEEDING ROLLER

(75) Inventors: Yasuchika Ito, Hyogo (JP); Hirokazu Nishimori, Hyogo (JP); Takeshi Ishimaru, Hyogo (JP); Noriaki Hitomi, Hyogo (JP)

(73) Assignee: Sumitomo Rubber Industries, Ltd., Kobe-shi (JP)

( * ) Notice: Subject to any disclaimer, the term of this patent is extended or adjusted under 35 U.S.C. 154(b) by 287 days.

(21) Appl. No.: 11/221,988

(22) Filed: Sep. 9, 2005

(65) Prior Publication Data

US 2006/0082042 A1 Apr. 20, 2006

(30) Foreign Application Priority Data

Oct. 14, 2004 (JP) ..... 2004-300593

(51) Int. Cl.
*B65H 3/06* (2006.01)

(52) U.S. Cl. ..... 271/109; 492/56; 492/49

(58) Field of Classification Search ..... 271/109; 492/49

See application file for complete search history.

(56) References Cited

U.S. PATENT DOCUMENTS 5,089,851 A * 2/1992 Tanaka et al. ..... 399/176
5,725,209 A * 3/1998 Takahashi et al. ..... 271/122
6,273,415 B1 * 8/2001 Tengo et al. ..... 271/109
6,945,921 B2 * 9/2005 Sirejacob ..... 492/56
2002/0039955 A1 4/2002 Takeda et al.
2002/0145247 A1 * 10/2002 Matsuo et al. ..... 271/109

FOREIGN PATENT DOCUMENTS

JP 2001-341862 A 12/2001
JP 2002-48130 A 2/2002
JP 2002-347972 A 12/2002

* cited by examiner

*Primary Examiner*—Patrick H Mackey
*Assistant Examiner*—Luis Gonzalez
(74) *Attorney, Agent, or Firm*—Birch, Stewart, Kolasch & Birch, LLP

(57) ABSTRACT

A paper-feeding roller (3) including a core (2) and a rubber roll (1) mounted on a peripheral surface of the core (2). The rubber roll (1) has a three-layer construction composed of an inner layer (11), an intermediate layer (12), and an outer layer (13). The inner layer (11), the intermediate layer (12), and the outer layer (13) are a non-foamed layer respectively. The JIS-A hardness of the inner layer (11) is set to not more than 10 degrees. The JIS-A hardness of the outer layer (13) is set to a range of 25 to 60 degrees.

11 Claims, 2 Drawing Sheets

PAPER-FEEDING ROLLER

This nonprovisional application claims priority under 35 U.S.C. § 119(a) on Patent Application No(s). 2004-300593 filed in Japan on Oct. 14, 2004, the entire contents of which are hereby incorporated by reference.

BACKGROUND OF THE INVENTION

1. Field of the Invention

The present invention relates to a paper-feeding roller for use in a paper-feeding mechanism of a copying machine, a printer, a facsimile apparatus, and the like. More particularly, in the paper-feeding roller of the present invention, an annular elastic member (rubber roll) mounted on the peripheral surface of a core has a three-layer construction composed of an inner layer, an intermediate layer, and an outer layer. The hardness of each of the three layers is preferably set to suppress a drop of the coefficient of friction of the paper-feeding roller and generation of a chattering phenomenon.

2. Description of the Related Art

Various types of paper-feeding rollers are used for paper-feeding mechanisms of an electrostatic copying machine, various types of printers, a facsimile apparatus, an automatic teller machine (ATM), and the like. The paper-feeding roller means a roller that transports paper owing to friction between the surface thereof and paper, with the paper-feeding roller rotating in contact with the paper. The paper-feeding roller includes a paper-supplying roller, a resist roller, a transfer roller, and the like.

As the material for the rubber roll of the paper-feeding roller, natural rubber, urethane rubber, ethylene-propylene-diene rubber (EPDM) rubber, polynorbornane rubber, silicone rubber, chlorinated polyethylene rubber, and the like have been hitherto used.

Many rubber rolls composing the paper-feeding roller have a one-layer construction consisting of a non-foamed layer. The coefficient of friction of the rubber roll having the one-layer construction is liable to drop, when a large number of paper is supplied thereto. As a result, the rubber roll deteriorates in its paper-feeding performance. Thereby defective paper-feeding occurs or a chattering phenomenon is generated owing to sliding of paper on the surface of the rubber roll. In recent years, there are proposed rubber rolls having a two-layer construction or a three-layer construction to improve the wear resistance thereof and suppress a drop of the coefficient of friction thereof.

For example, disclosed in Japanese Patent Application Laid-Open No. 2001-341862 (patent document 1) is the rubber roll having the two-layer construction composed of the foamed inner layer and the non-foamed outer layer. Also disclosed in the patent document 1 is the rubber roll having the three-layer construction composed of the non-foamed inner layer, the foamed intermediate layer, and the non-foamed outer layer.

In the patent document 1, to allow the rubber roll to have a preferable coefficient of friction and nip amount, the ASKA-C hardness of the foamed layer is adjusted to not more than 50 degrees, and the JIS-A hardness of the non-foamed layer is adjusted to not more than 60 degrees. The inner layer of the rubber roll having the three-layer construction is provided to fix the rubber roll to the core strongly.

Disclosed in Japanese Patent Application Laid-Open No. 2002-48130 (patent document 2) is the rubber roll having the three-layer construction composed of the base rubber layer (inner layer) that is considered to be non-foamed layer and the comparatively thin intermediate and outer layers those are considered to be a non-foamed layer respectively formed on the peripheral surface of the base rubber layer. Proposed in the patent document 2 is the composition of the base rubber layer effective for improving fatigue resistance of the rubber roll and suppressing bleeding of components, but the hardness of the intermediate layer and that of the outer layer are not specified.

The rubber roll having the two-layer construction composed of the inner layer and the outer layer is disclosed in Japanese Patent Application Laid-Open No. 2002-347972 (patent document 3). The JIS-A hardness of the inner layer and that of the outer layer are adjusted to a specific range respectively. To improve the wear resistance of the outer layer and reduce the generation of the chattering phenomenon, the JIS-A hardness of the outer layer and that of the inner layer are adjusted to the range of 35 to 50 degrees and not more than 25 degrees respectively.

Patent document 1: Japanese Patent Application Laid-Open No. 2002-341862

Patent document 2: Japanese Patent Application Laid-Open No. 2002-48130

Patent document 3: Japanese Patent Application Laid-Open No. 2002-347972

SUMMARY OF THE INVENTION

It is an object of the present invention to suppress a drop of the coefficient of friction of the paper-feeding roller and the generation of the chattering phenomenon in spite of repetition of supply of paper thereto. To achieve the object, it is necessary to control the JIS-A hardness of each layer appropriately. Therefore the object of the present invention cannot be achieved by the construction disclosed in the patent document 2 in which attention is focused on only the composition of the rubber of the inner layer.

When the rubber of the outer layer has a high hardness and the rubber of the inner layer has a low hardness, as disclosed in the patent documents 1 and 3, the effect of improving the wear resistance of the outer layer and reducing the generation of the chattering phenomenon is obtained to some extent, but insufficient. To achieve the object of the present invention, it is necessary to specify the difference between the hardness of the inner layer and that of the outer layer and so construct the paper-feeding roller as to prevent substances from migrating between the inner layer and the outer layer.

To solve the above-described problems, the present invention provides a paper-feeding roller having a core and an annular elastic member mounted on a peripheral surface of the core. The annular elastic member has a three-layer construction composed of an inner layer, an intermediate layer, and an outer layer. The inner layer, the intermediate layer, and the outer layer are a non-foamed layer respectively. A JIS-A hardness of the inner layer is set to not more than 10 degrees. A JIS-A hardness of the outer layer is set to a range of 25 to 60 degrees.

Both the inner and outer layers of the annular elastic member (rubber roll) of the paper-feeding roller are made of a rubber composition vulcanized and molded. But the intermediate layer does not necessarily have to be made of the rubber composition.

The reason the inner layer, the intermediate layer, and the outer layer are formed as the non-foamed layer is because it is possible to hold the hardness of the non-foamed layer at a predetermined hardness more reliably than the foamed layer and set the hardness of each non-foamed layer uniformly to the predetermined hardness. In addition, it is unnecessary to foam the rubber composition by adding a foaming agent thereto in manufacturing the paper-feeding roller. Thus the non-foamed layer prevents the hardness of the rubber roll from having a variation that is occurred by a variation of foaming.

As described above, by setting the JIS-A hardness of the inner layer to a low degree, namely, not more than 10 degrees, it is possible to sufficiently secure the area of contact between the rubber roll and paper and easy to suppress the drop of the coefficient of friction thereof. Thereby it is possible to reduce the generation of the chattering phenomenon. When the JIS-A hardness of the inner layer is more than 10 degrees, it is difficult to sufficiently secure the area of contact between the rubber roll and the paper for a long time and suppress the drop of the coefficient of friction of the rubber roll. The lower limit of the JIS-A hardness of the inner layer is one degree.

By setting the JIS-A hardness of the inner layer high, namely, to the range of 25 to 60 degrees, the paper-feeding roller is capable of having a favorable balance between the wear resistance and the coefficient of friction.

When the outer layer and the inner layer contact each other in the case where the difference between the JIS-A hardness of the outer layer and that of the inner layer is not less than 15 degrees, there is a high possibility that material components bleed from the inner layer and/or the outer layer and substances migrate between the inner layer and the outer layer. To prevent such migration and bleeding from occurring, the intermediate layer is provided between the inner layer and the outer layer.

It is preferable that the inner layer is composed of ethylene-propylene-diene rubber (EPDM rubber). It is desirable that the rubber composition composing the inner layer contains carbon black to enhance the strength of the rubber.

The EPDM rubber is also suitable as the material of the outer layer because the EPDM rubber is ozone-resistant. It is desirable that the rubber composition composing the outer layer contains an inorganic filler such as silicon oxide, calcium carbonate, and titanium oxide to enhance the strength of the rubber and the processability thereof.

It is desirable to adjust the hardness of the inner layer and that of the outer layer by adding a necessary amount of paraffin oil and a filler to the rubber.

It is preferable that the intermediate layer is composed of polyurethane. The intermediate layer consisting of the polyurethane is effective for suppressing the substances from migrating between the inner layer and the outer layer. When the outer layer is composed of the EPDM rubber, there is a big difference between the SP value of the polyurethane and that of EPDM rubber. Thus the intermediate layer is effective for suppressing the substances from migrating between the inner layer and the outer layer to a higher extent.

It is preferable that the outer layer formed annularly is integrally fitted on the peripheral surface of the intermediate layer without interposing an adhesive agent between the outer layer and the intermediate layer.

By integrating the outer layer with the peripheral surface of the intermediate layer without interposing the adhesive agent therebetween, it is possible to replace only the outer layer, when the outer layer finishes its life owing to deterioration caused by contact between the outer layer and the outside air or paper.

To sufficiently suppress the drop of the coefficient of friction of the paper-feeding roller and the generation of the chattering phenomenon, the difference between the JIS-A hardness of the outer layer and the JIS-A hardness of the inner layer is set to favorably the range of 15 to 55 degrees and more favorably to the range of 20 to 50 degrees. If the difference between the JIS-A hardness of the outer layer and that of the inner layer is less than 15 degrees, it is impossible to obtain the effect of sufficiently suppressing the generation of the chattering phenomenon. On the other hand, if the difference between the JIS-A hardness of the outer layer and that of the inner layer is more than 55 degrees, the outer layer has a high hardness and hence a low coefficient of friction.

The initial coefficient of friction of the peripheral surface of the outer layer is set to favorably not less than 1.5 and more favorably not less than 2.0 nor more than 3.5.

The paper-feeding roller of the present invention has hardly a drop in the coefficient of friction thereof and hardly generates the chattering phenomenon in spite of repetition of supply of paper thereto. Further material components are prevented from bleeding from the inner layer and/or the outer layer of the rubber roll, and substances are prevented from migrating between the inner layer and the outer layer thereof. Therefore the paper-feeding roller has a very long life and an excellent performance for a long time.

DETAILED DESCRIPTION OF THE PREFERRED EMBODIMENTS

The embodiments of the present invention will be described below with reference to drawings.

Figure 1:
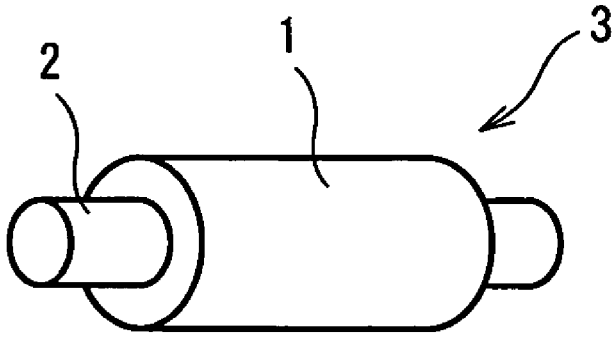
FIG. 1 is a perspective view showing a paper-feeding roller of the present invention.

FIG. 1 is a perspective view of a paper-feeding roller 3 of the present invention. The paper-feeding roller 3 has a cylindrical annular elastic member (rubber roll) 1 having a three-layer construction and a columnar core (shaft) 2 inserted into a hollow portion of the annular elastic member 1. Although the thickness of the rubber roll 1 is not set specifically, the thickness thereof is set to not less than 1 mm nor more than 20 mm in the embodiment. Although the length of the rubber roll 1 is not set specifically, the length thereof is set to not less than 3 mm nor more than 200 mm in the embodiment.

Figure 2:
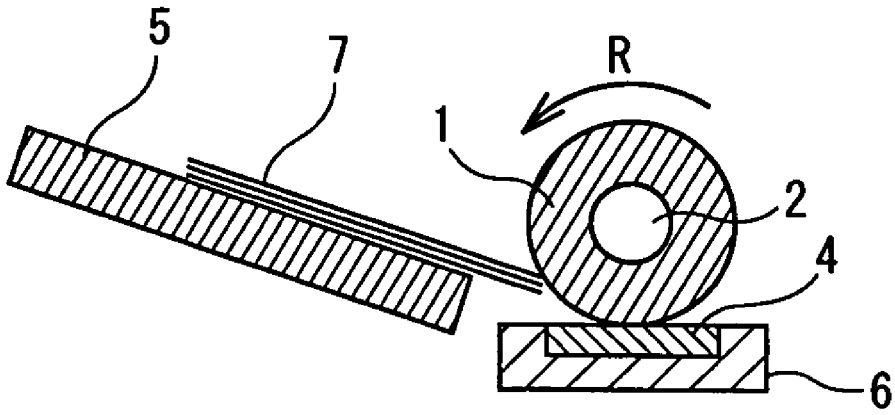
FIG. 2 is an illustrative sectional view showing an example of a paper-feeding mechanism including the paper-feeding roller shown in FIG. 1.

FIG. 2 is an illustrative sectional view showing an example of a paper-feeding mechanism in which the paper-feeding roller 3 is used as a paper-supplying roller. The paper-feeding mechanism has a paper-feeding roller 3, a separation pad 4, and a tray 5. The separation pad 4 and the tray 5 are spaced at a certain interval. An angle of elevation is formed between an upper surface of the separation pad 4 and that of the tray 5. The separation pad 4 is fixed to a substrate 6. The separation pad 4 and the paper-feeding roller 3 are opposed to each other.

Paper 7, disposed on the tray 5, which is in contact with the surface of the paper-feeding roller 3 is fed out of the tray 5 one by one in the direction shown by the arrow R of FIG. 1 owing to the rotation of the paper-feeding roller 3.

Figure 3:
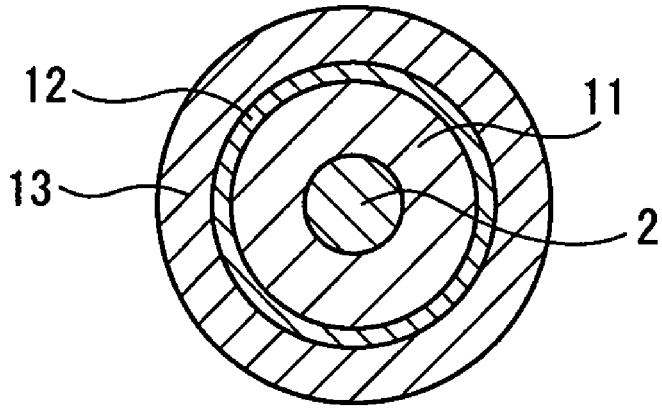
FIG. 3 is a sectional view showing a rubber roll of the present invention.

As shown in FIG. 3 which is a sectional view, the rubber roll 1 has a three-layer construction composed of an inner layer 11, an intermediate layer 12, and an outer layer 13. The inner layer 11, the intermediate layer 12, and the outer layer 13 are a non-foamed layer respectively. The inner layer 11 and the outer layer 13 are made of a rubber composition respectively, whereas the intermediate layer 12 is made of a rubber component or a resin component.

The inner layer 11 is vulcanized to shape it cylindrically and made of the rubber composition having not less than one degrees nor more than 10 degrees in the JIS-A hardness. The thickness of the inner layer 11 is set to not less than 2 mm nor more than 10 mm. If the thickness of the inner layer 11 is too small, it has a reduced effect of suppressing the generation of chatter. On the other hand, if the thickness of the inner layer 11 is too large, the inner layer 11 is liable to be locally worn.

The intermediate layer 12 can be formed by coating the peripheral surface of the inner layer 11 with resin. The intermediate layer 12 plays the role of preventing migrations of substances between the inner layer and the outer layer and suppressing bleeding of material components from the inner layer 11 and/or the outer layer 13. Therefore as the substance composing the intermediate layer 12, it is preferable to use resin having a low compatibility with the rubber component of the inner layer 11 and the outer layer 13. Thus POM, PET, nylon, ABS, vinyl chloride, and the like are used as the resin composing the intermediate layer 12. Paraffin oil is added to EPDM rubber composing the outer layer 13, because the EPDM rubber is compatible with the paraffin oil.

The intermediate layer 12 may be formed not only by coating, but also by dipping or may be formed from a heat-shrinkable tube.

It is possible to use polyurethane, polyamide, ABS, PET, and vinyl chloride as the resin composing the intermediate layer 12. The polyurethane is most favorable because it has a favorable processability.

The JIS-A hardness of the intermediate layer 12 is preferably in the range from 30 to 80 degrees so that the resin composing the intermediate layer 12 has a high processability.

The thickness of the intermediate layer 12 is not set specifically, but should be set preferably not less than 0.05 mm nor more than 0.2 mm. If the thickness of the intermediate layer 12 is too small, the intermediate layer 12 has a very low effect of preventing migrations of substances between the inner layer and the outer layer and suppressing the bleeding of material components from the inner layer 11 and/or the outer layer 13. In this case, the intermediate layer 12 is incapable of achieving the object of the present invention sufficiently. On the other hand, if the thickness of the intermediate layer 12 is too large, an effect to be obtained by softening the inner layer 11 is lost.

The outer layer 13 is cylindrical and made of the vulcanized rubber composition having 25 to 60 degrees in the JIS-A hardness. If the JIS-A hardness of the outer layer 13 is less than 25 degrees, the outer layer 13 has a low wear resistance. On the other hand, if the JIS-A hardness of the outer layer 13 is more than 60 degrees, the outer layer 13 has a low initial coefficient of friction.

The thickness of the outer layer 13 is not set specifically, but should be set preferably not less than 1 mm nor more than 3 mm. If the thickness of the outer layer 13 is too small, the rubber roll has a short life. On the other hand, if the thickness of the outer layer 13 is too large, the effect to be obtained by softening the inner layer 11 is lost.

To sufficiently suppress the drop of the coefficient of friction of the paper-feeding roller and the generation of the chattering phenomenon, the difference between the JIS-A hardness of the outer layer 13 and the JIS-A hardness of the inner layer 11 is set favorably to the range of 15 to 55 degrees and more favorably to the range of 20 to 50 degrees. If the difference between the JIS-A hardness of the outer layer 13 and the JIS-A hardness of the inner layer 11 is less than 15 degrees, it is impossible to obtain the effect of sufficiently suppressing the drop of the coefficient of friction of the paper-feeding roller and the generation of the chattering phenomenon. On the other hand, if the difference between the JIS-A hardness of the outer layer 13 and the JIS-A hardness of the inner layer 11 is more than 55 degrees, the paper-feeding roller has a low initial coefficient of friction.

The rubber composition constituting the inner layer 11 and the outer layer 13 contains rubber essentially and various additives. The additive includes a crosslinking agent, a filler, a softening agent, a reinforcing agent, a crosslinking assistant agent, a coloring agent, and an anti deteriorating agent. The JIS-A hardness of the inner layer and that of the outer layer can be controlled by appropriately adjusting the addition amount of the softening agent such as the paraffin oil and the filler. That is, the rubber composition composing the inner layer 11 and the outer layer 13 does not necessarily have to contain specific components, but may contain suitable components, provided that the desired JIS-A hardness is obtained.

The kind of rubber for use in the inner layer 11 and the outer layer 13 is not set specifically. But it is possible to use ethylene-propylene-diene rubber (EPDM rubber), silicone rubber, urethane rubber, polynorbornane, chlorinated polyethylene, polyisoprene, polybutadiene, natural rubber, styrene-butadiene rubber (SBR), and nitrile rubber (NBR). These rubbers can be used singly or in combination of two or more of them.

In the present invention, it is possible to use both an oil-unextended rubber consisting of a rubber component and an oil-extended rubber containing the rubber component and extended oil.

Of the above-described rubbers, the EPDM rubber is particularly preferable for composing the inner layer 11 and the outer layer 13. Because the EPDM rubber consists of saturated hydrocarbon and includes no double bonds, the EPDM is superior in weatherability and oxidation resistance thereof and hardly deteriorates. Thus the rubber roll composed of the EPDM rubber hardly deteriorates, even though it is exposed to an ozone atmosphere having a high concentration and to irradiation of light beams for a long time.

In using the ethylene-propylene-diene rubber and other rubbers in combination, favorably not less than 50 wt % of the ethylene-propylene-diene rubber and more favorably not less than 80 wt % thereof is used for the entire rubber component to obtain the effect of enhancing a high weatherability and oxidation resistance of the rubber roll.

The EPDM rubber is particularly suitable for composing the inner layer 11 because the inner layer 11 composed of the EPDM rubber is allowed to have a low hardness.

As crosslinking agents to be contained in the rubber composition, it is possible to use sulfur, sulfur compounds, metal oxides, organic peroxides, and inorganic peroxides. It is preferable to select an appropriate crosslinking agent in dependence on the kind of rubber.

As the sulfur compounds, it is possible to use thiuram compounds such as tetramethylthiuram monosulfide (TMTM), tetramethylthiuram disulfide (TMTD), tetraethylthiuram disulfide (TETD), tetrabutylthiuram disulfide (TBTD), dipentamethylenethiuram tetrasulfide (DPTT); thiazole compounds such as 2-melcapto·benzothiazole (MBT), dibenzothiazolyl disulfide; zinc 2-melcapto·benzothiazole (ZnMBT), sodium 2-melcapto·benzothiazole (NaMBT), cyclohexylammonium 2-melcapto·benzothiazole (CMBT), 2-(2,4-dinitrophenylthio) benzothiazole (DPBT); sulfinamide compounds such as N-cyclohexyl-2-benzothiazolesulfinamide (CBS), N-t-butyl-2-benzothiazolesulfinamide (BBS), N-oxyethylene-2-benzothiazolesulfineamide (OBS), N,N'-diisopropyl-2-benzothiazolesulfineamide (DPBS), N,N'-dicyclohexyl-2-benzothiazolesulfineamide; and compounds of metal dithiocarbamate such as dimethyldithiocarbamate, diethyldithiocarbamate, di-n-butyldithiocarbamate, pentamethylenedithiocarbamate, and ethylphenyldithiocarbamate. These sulfur compounds can be used singly or in combination of two or more of them.

As the metal oxides to be contained in the rubber composition, it is possible to use zinc oxide, magnesium oxide, and aluminum oxide. These metal oxides can be used singly or in combination of two or more of them.

As the organic peroxides, the following substances are preferable: dicumyl peroxide (DCP), 1,3-bis (t-butyl peroxyisopropyl) benzene, 1,4-bis (t-butyl peroxyisopropyl) 3,3,5-trimethylcyclohexane, 2,5-dimethyl-2,5-di-(t-butyl peroxy) hexyne, n-butyl-4,4-bis (t-butyl peroxy) valerate, and 2,5-dimethyl-2,5-bis (t-butyl peroxy) hexane. These peroxides can be used singly or in combination.

As the inorganic peroxides, it is possible to use hydrogen peroxide, and the like. The inorganic peroxides can be used singly or in combination.

As the filler to be contained in the rubber composition, it is possible to use mineral inorganic fillers such as calcium carbonate, titanium oxide, magnesium carbonate; ceramic powder; and wood powder. The rubber composition containing the fillers improves the mechanical strength of the rubber roll. It is preferable for the rubber composition constituting the outer layer to contain the mineral inorganic filler.

As the softening agent to be contained in the rubber composition, oil and a plasticizer can be used. It is possible to adjust the hardness of the rubber composition by adding the softening agent to the rubber component. As the oil, it is possible to use mineral oil such as paraffin oil, naphthenic oil, aromatic oil; synthetic oil consisting of hydrocarbon oligomer; and process oil. As the synthetic oil, oligomer of α-olefin, oligomer of butane, and amorphous oligomer of ethylene and α-olefin are preferable. As the plasticizer, it is possible to use dioctyl phthalate (DOP), dibutyl phthalate (DBP), dioctyl sebacate (DOS), and dioctyl adipate (DOA).

Carbon black or the like can be used as the reinforcing agent to be contained in the rubber composition. It is possible to improve the wear resistance of the rubber roll by adding the carbon black to the rubber component. As the carbon black, it is possible to use HAF, MAF, FEF, GPF, SRF, SAF, MT, and FT. It is preferable that the diameter of the particle of the carbon black is not less than 10 μm nor more than 100 μm to disperse the carbon black favorably in the rubber composition. In the present invention, to increase the strength of the rubber, it is preferable for the rubber composition constituting the inner layer to contain the carbon black.

It is preferable that the rubber composition constituting the inner layer 11 contains not less than 25 to 70 parts by weight of the carbon black and 150 to 300 parts by weight of the paraffin oil for 100 parts by weight of the EPDM rubber.

It is preferable that the rubber composition constituting the outer layer 13 contains not less than 25 to 70 parts by weight of the mineral inorganic filler and not more than 300 parts by weight of the paraffin oil for 100 parts by weight of the EPDM rubber. As the mineral fillers, it is preferable to use silicon oxide, calcium carbonate, titanium oxide, and the like singly or in combination.

The rubber composition is formed by using an ordinary method conventionally carried out. For example, rubber, a crosslinking agent, and additives are kneaded by using a known rubber kneader such as an open roll, a Banbury mixer, and the like to obtain the rubber composition. The components are kneaded at 70° C. to 100° C. for about three to 10 minutes.

As the method of vulcanizing and molding the rubber composition, it is possible to use extrusion molding and transfer molding. For example, it is possible to vulcanize the rubber composition and mold it tubularly at the same time by introducing an unvulcanized rubber composition into a transfer molding die and heating it at 150° C. to 200° C. for five to 30 minutes. Thereafter an obtained rubber tube is abraded with a cylindrical grinder until the rubber tube has a desired outer diameter. Then the rubber tube is cut to a desired length. Thereby the inner layer and the outer layer of the rubber roll are obtained.

Without using an adhesive agent, the tubular outer layer can be fitted on the peripheral surface of the intermediate layer formed on the peripheral surface of the inner layer. In this case, it is desirable to set the inner diameter ϕa of the outer layer a little smaller than the outer diameter ϕb of the layer formed by combining the intermediate layer and the inner layer.

The examples of the present invention and the comparison examples will be described in detail below.

A rubber composition of each of the examples and the comparison examples was prepared in accordance with compositions A through G shown in table 1. The unit of the numerical values showing amounts of the components is part by weight.

TABLE 1

| | Composition | | | | | | |
|---|---|---|---|---|---|---|---|
| | Inner layer | | | Outer layer | | | |
| | A | B | C | D | E | F | G |
| EPDM rubber A | 200 | 200 | 200 | 200 | 200 | 200 | |
| EPDM rubber B | | | | | | | 100 |
| Silicon oxide | | | | 10 | 10 | 15 | 10 |
| Calcium carbonate | | | | 30 | 30 | 30 | |
| Titanium oxide | | | | 15 | 15 | 15 | 5 |
| Carbon black | 40 | 40 | 40 | 1 | 1 | 1 | 1 |
| Paraffin oil | 220 | 200 | 180 | 40 | 20 | | |
| Zinc oxide | 5 | 5 | 5 | 5 | 5 | 5 | 5 |
| Stearic acid | 1 | 1 | 1 | 1 | 1 | 1 | 1 |
| Powdery sulfur | 1 | 1 | 1 | 1 | 1 | 1 | 1 |
| Tetraethylthiuram disulfide | 2 | 2 | 2 | 2 | 2 | 2 | 2 |
| Dibenzothiazolyl disulfide | 1 | 1 | 1 | 1 | 1 | 1 | 1 |
| Hardness (degree) | 5 | 10 | 15 | 20 | 25 | 30 | 60 |

The components shown in table 1 are as follows:

EPDM rubber A: "Esprene 670A (commercial name)" produced by Sumitomo Kagaku Kogyo Inc.

EPDM rubber B: "Esprene 505A (commercial name)" produced by Sumitomo Kagaku Kogyo Inc.

Silicon oxide: "Nipseal VN3 (commercial name)" produced by Toso•Silica Kogyo Inc.

Calcium carbonate: "BF300 (commercial name)" produced by Bihoku Funka Kogyo Inc.

Titanium oxide: "Chronos titanium oxide KR380 (commercial name)" produced by Titanium Kogyo Inc.

Carbon black: "Sheast SO (commercial name)" produced by Tokai carbon Inc.

Paraffin oil: "PW-380" (commercial name)" produced by Idemitsu Kosan Inc.

Zinc oxide: "two kinds of zinc oxide" (commercial name) produced by Mitsui Kinzoku Kogyo Inc.

Stearic acid: "Tsubaki (commercial name)" produced by Nippon Yushi Inc.

Powdery sulfur: Powdery sulfur produced by Tsurumi Kagaku Kogyo Inc.

Tetraethylthiuram disulfide: "Knockseller TET (commercial name)" produced by Ouchi Shinko Kagaku Kogyo Inc.

Dibenzothiazolyl disulfide: "Knockseller DM (commercial name)" produced by Ouchi Shinko Kagaku Kogyo Inc.

The EPDM rubber A is oil-extended rubber containing 50 wt % of the EPDM rubber and 50 wt % of extended oil.

Comparison Example 1

A solid (one layer) rubber roll was prepared in a manner described below.

Initially a rubber composition having a composition E shown in table 2 was introduced into a die to perform press vulcanization at 170° C. for 20 minutes. Thereby a cot having an inner diameter of ø9 mm, an outer diameter of ø21 mm, and a length of 38 mm was obtained. Thereafter the obtained cot was abraded with a cylindrical grinder until the outer diameter thereof became ø20 mm. Then the cot was cut to a piece having a length of 10 mm. A core was inserted into a rubber roll obtained by cutting the cot. Thereby the paper-feeding roller of the example 1 was obtained.

Examples 1 Through 4 and Comparison Examples 2 and 3

(1) Formation of Inner Layer

A rubber composition having a composition shown in table 2 was introduced into a die to perform press vulcanization at 160° C. for 20 minutes. Thereby a cot having an inner diameter of ø9 mm, an outer diameter of ø15 mm, and a length of 60 mm was obtained. Thereafter the obtained cot was cut to a piece having a length of 10 mm. The piece was used as the inner layer of a rubber roll.

TABLE 2

| | CE1 | E1 | E2 | E3 | CE2 | CE3 | E4 |
|---|---|---|---|---|---|---|---|
| Composition of inner layer | | A | B | A | C | B | B |
| Hardness of inner layer (degree) | | 5 | 10 | 5 | 15 | 10 | 10 |
| Composition of outer layer | | E | F | G | E | D | E |
| Hardness of outer layer (degree) | | 25 | 30 | 60 | 25 | 20 | 25 |
| Difference between hardness of inner layer and that of outer layer | | 20 | 20 | 55 | 10 | 10 | 15 |
| Composition of one-layer construction | E | | | | | | |
| Hardness (degree) of one-layer construction | 25 | | | | | | |
| Initial coefficient of friction | 1.9 | 2.1 | 2.0 | 1.7 | 2.0 | 2.1 | 2.0 |
| Coefficient of friction after supply of paper to rubber roll | 1.5 | 2.0 | 1.9 | 1.6 | 1.5 | — | 1.9 |
| Evaluation of chatter | Chattered | Did not chatter | Did not chatter | Did not chatter | Chattered | Did not chatter | Did not chatter |
| Evaluation of supply of paper (50000 sheets) to rubber roll | ○ | ○ | ○ | ○ | ○ | X | ○ |

where E denotes example and where CE denotes comparison example.

(2) Formation of Intermediate Layer

The peripheral surface of the inner layer of the obtained rubber roll was coated with polyurethane (K69 (commercial name) produced by Tokyo Netsu Kagaku Kogyo Inc.) to form the intermediate layer having a thickness of 0.1 mm.

(3) Formation of Outer Layer

A rubber composition having a composition shown in table 2 was introduced into a die to perform press vulcanization at 160° C. for 20 minutes. Thereby a cot having an inner diameter of ø14 mm, an outer diameter of ø21 mm, and a length of 60 mm was obtained. Thereafter the obtained cot was abraded with a cylindrical grinder until the outer diameter thereof became ø20 mm. Then the cot was cut to a piece having a length of 10 mm to obtain the outer layer of the rubber roll.

(4) Formation of Paper-feeding Roller Having Three-layer Construction

A core was inserted into the inner layer having the intermediate layer formed on its peripheral surface. The outer layer was fitted on the peripheral surface of the intermediate layer without using an adhesive agent. In this manner, the paper-feeding roller was completed.

Evaluation

Evaluation of Hardness of Inner Layer and Outer Layer

The JIS-A hardness of the vulcanized rubber was measured by using a spring type hardness meter of A-type specified in JIS-K6253. Table 2 shows the JIS-A hardness of the inner layer, the JIS-A hardness of the outer layer, and the difference between the JIS-A hardness of the inner layer and that of the outer layer.

Evaluation of Initial Coefficient of Friction

Figure 4:
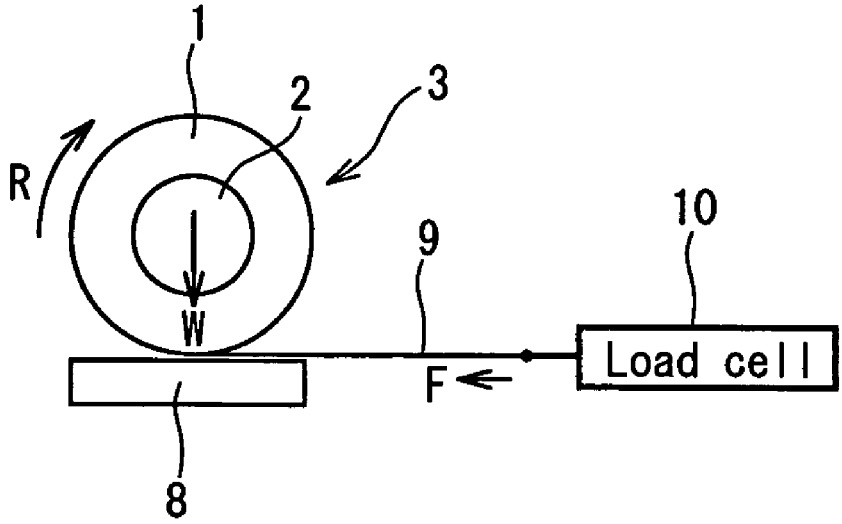
FIG. 4 shows the method of measuring the coefficient of friction of the paper-feeding roller.

The coefficient of friction of each paper-feeding roller was measured by using a method illustrated in FIG. 4. Initially one end of a sheet of paper 9 (produced by Fuji Xerox Inc.) having a size of 60 mm×210 mm was sandwiched between a paper-feeding roller 3 and a fixed plate 8 made of polytetrafluoroethylene (PTFE) with the other end of the paper 9 connected to a load cell 10. Thereafter a load W of 250 gf was vertically applied to the plate 8 in the direction from the paper-feeding roller 3 toward the plate 8.

Thereafter the paper-feeding roller 3 was rotated at a peripheral speed of 300 mm/second in the direction shown with the arrow R in FIG. 4 at a temperature of 23° C. and a humidity of 55%. A feed force F applied to the load cell 10 at that time was measured. The coefficient of friction μ was computed from the feed force F and the load W (W=250 gf) by using an equation 1 shown below:

$$\mu = F(\text{gf})/250(\text{gf}) \qquad \text{Equation 1}$$

In order for the paper-feeding roller to perform a predetermined function, it is necessary that the initial coefficient of friction thereof is not less than 1.5.

Evaluation of Feed of Paper

Each paper-feeding roller was mounted on a copying apparatus "VIVACE455 (commercial name) manufactured by Fuji Xerox Inc. 50000 sheets of paper were fed to the printer to observe whether the paper was fed favorably. The paper-feeding roller which fed the paper favorably was marked as ○. The paper-feeding roller which failed to feed the paper and the paper-feeding roller which fed a plurality of sheets of paper at a time were marked as X.

Friction of Coefficient after Feed of Paper

After the evaluation on the feed of the paper to each rubber roll was made, the paper-feeding roller was removed from the copying apparatus. In a method similar to that used in measuring the initial coefficient of friction, the coefficient of friction of the paper-feeding roller was measured after 50000 sheets of the paper was fed thereto.

In order for the paper-feeding roller to have a sufficient durability, it is necessary that the paper-feeding roller has not less than 1.2 as the coefficient of friction after 50000 sheets of the paper was fed thereto.

Evaluation of Chatter

Each paper-feeding roller was mounted on a copying apparatus "VIVACE455 (commercial name) manufactured by Fuji Xerox Inc. 1000 sheets of paper were fed to each paper-feeding roller to check whether the paper-feeding roller chattered. The paper-feeding roller which chattered during the feed of 1000 sheets of paper thereto was marked as "chattered". The paper-feeding roller which did not chatter during the feed of 1000 sheets of paper thereto was marked as "did not chatter".

Table 2 shows the results of the evaluation of the chatter.

Examination of Results

The paper-feeding roller of the comparison example 1 having the one-layer construction was evaluated favorably in the feed of the paper thereto. But the paper-feeding roller chattered. The ratio of the coefficient of friction of the paper-feeding roller after the paper was fed thereto to the initial coefficient of friction thereof was about 0.79. That is, the paper-feeding roller had a comparatively large reduction in its coefficient of friction.

The paper-feeding roller of the comparison example 2 having the three-layer construction was very high, namely, 15 degrees in the JIS-A hardness of its inner layer. Further the difference between the JIS-A hardness of the inner layer and that of the outer layer was only 10 degrees. Although the paper-feeding roller of the comparison example 3 was evaluated favorably in the feed of the paper thereto, it chattered. The ratio of the coefficient of friction of the paper-feeding roller after the paper was fed thereto to the initial coefficient of friction thereof was about 0.75. That is, the paper-feeding roller had a comparatively large reduction in its coefficient of friction.

The paper-feeding roller of the comparison example 3 having the three-layer construction was very low, namely, 20 degrees in the JIS-A hardness of its outer layer. Further difference between the JIS-A hardness of the inner layer and that of the outer layer was only 10 degrees. Thus the paper-feeding roller did not chatter. But the outer layer was worn to a high extent in the evaluation of the feed of the paper thereto. That is, the paper-feeding roller cannot be practically used. The coefficient of friction of the paper-feeding roller after the paper was fed thereto could not be measured.

Each of the paper-feeding rollers of the examples 1 through 4 had not more than 10 degrees in the JIS-A hardness of the inner layer thereof and not less than 25 degrees in the JIS-A hardness of the outer layer thereof. The difference between the JIS-A hardness of the inner layer and that of the outer layer was in the range of 15 to 55 degrees. Thus the paper-feeding roller did not chatter. A favorable evaluation was given to the paper-feeding rollers in the feed of the paper thereto. The ratio of the coefficient of friction of each paper-feeding roller after the paper was fed thereto to the initial coefficient of friction thereof was not less than 0.94. That is, there was little drop in the coefficient of friction thereof.

INDUSTRIAL APPLICABILITY

The paper-feeding roller of the present invention can be reliably used for paper-feeding mechanisms of various types of printers, an electrostatic copying machine, a facsimile apparatus, an automatic teller machine (ATM), and the like. The paper-feeding roller is very useful for a high-performance paper-feeding mechanism demanded to suppress the generation of the chattering phenomenon and have a high durability.

What is claimed is:

1. A paper-feeding roller comprising a core and an annular elastic member mounted on a peripheral surface of said core, wherein said annular elastic member has a three-layer construction composed of a non-foamed inner layer having a JIS-A hardness of 1 to 10 degrees and a thickness of 2 to 10 mm; a non-foamed intermediate layer having a JIS-A hardness of 30 to 80 degrees and a thickness of 0.05 to 0.2 mm; and a non-foamed outer layer having a JIS-A hardness of 25 to 60 degrees and a thickness of 1 to 3 mm; said inner layer being made of rubber composition containing not less than 25 to 70 parts by weight of a carbon black and 150 to 300 parts by weight of a paraffin oil for 100 parts by weight of an ethylene-propylene-diene rubber (EPDM rubber); and said outer layer being made of rubber composition containing not less than 25 to 70 parts by weight of a mineral inorganic filler and not more than 300 parts by weight of a paraffin oil for 100 parts by weight of a EPDM rubber.

2. The paper-feeding roller according to claim 1, wherein said intermediate layer is composed of polyurethane.

3. The paper-feeding roller according to claim 1, wherein said outer layer formed annularly is integrally fitted on a peripheral surface of said intermediate layer without interposing an adhesive agent between said outer layer and said intermediate layer.

4. The paper-feeding roller according to claim 2, wherein said outer layer formed annularly is integrally fitted on a peripheral surface of said intermediate layer without interposing an adhesive agent between said outer layer and said intermediate layer.

5. The paper-feeding roller according to claim 1, wherein a difference between a JIS-A hardness of said outer layer and a JIS-A hardness of said inner layer is set to a range of 15 to 55 degrees.

6. The paper-feeding roller according to claim 2, wherein a difference between a JIS-A hardness of said outer layer and a JIS-A hardness of said inner layer is set to a range of 15 to 55 degrees.

7. The paper-feeding roller according to claim 3, wherein a difference between a JIS-A hardness of said outer layer and a JIS-A hardness of said inner layer is set to a range of 15 to 55 degrees.

8. The paper-feeding roller according to claim 1, wherein an initial coefficient of friction of a peripheral surface of said outer layer is set to not less than 1.5.

9. The paper-feeding roller according to claim 2, wherein an initial coefficient of friction of a peripheral surface of said outer layer is set to not less than 1.5.

10. The paper-feeding roller according to claim 3, wherein an initial coefficient of friction of a peripheral surface of said outer layer is set to not less than 1.5.

11. The paper-feeding roller according to claim 5, wherein an initial coefficient of friction of a peripheral surface of said outer layer is set to not less than 1.5.

* * * * *